United States Patent [19]

Dobrzanski et al.

[11] Patent Number: 4,962,368

[45] Date of Patent: Oct. 9, 1990

[54] RELIABILITY AND WORKABILITY TEST APPARATUS FOR AN ENVIRONMENTAL MONITORING SYSTEM

[75] Inventors: John J. Dobrzanski, New Britain, Conn.; Jeffrey J. McCabe, Owen Sound, Canada; Robert W. Right, Huntington, Conn.

[73] Assignee: General Signal Corporation, Stamford, Conn.

[21] Appl. No.: 347,543

[22] Filed: May 4, 1989

[51] Int. Cl.[5] ..... G08B 29/00

[52] U.S. Cl. ..... 340/514; 340/505; 340/511; 340/518; 340/825.08

[58] Field of Search ..... 340/514, 515, 501, 508, 340/511, 505, 518, 825.43, 825.52, 825.54, 825.06–825.13

[56] References Cited

U.S. PATENT DOCUMENTS

| | | | |
|---|---|---|---|
| 4,401,979 | 8/1983 | Dobrzanski | 340/629 |
| 4,517,554 | 5/1985 | Moser et al. | 340/514 |
| 4,518,952 | 5/1985 | Tanaka et al. | 340/514 |
| 4,692,750 | 9/1987 | Murakami et al. | 340/511 |
| 4,727,359 | 2/1988 | Yuchi et al. | 340/511 |
| 4,742,334 | 5/1988 | Teich et al. | 340/514 |
| 4,785,284 | 11/1988 | Kimura | 340/511 |

*Primary Examiner*—Donnie L. Crosland

*Attorney, Agent, or Firm*—Robert R. Hubbard; John F. Ohlandt

[57] ABSTRACT

An environmental monitoring system in which a controller is arranged to test the workability and reliability of a plurality of detector units on a cyclic basis. Each unit has an analog sensor and an analog to digital converter for converting the analog sensor voltage to a digital value in a range of 0 to N. Each unit responds to a test instruction to cause the sensor analog output to assume an alarm value. The sensor output is limited to a maximum value that under a no drift condition of the analog to digital converter, its corresponding digital signal value will be intermediate a tolerance range of values, the upper limit of such range being less than N. The controller includes a test routine program for both issuing the test instruction and for determining if the digital signal test value is within the tolerance range and issuing a trouble output indicative of the test value being outside the range. The controller also includes a polling program which directs the polling of the detector units such that a test instruction is sent sequentially to the detector units on successive loop polls, where a loop poll is one poll of all the units coupled to the line.

6 Claims, 5 Drawing Sheets

RELIABILITY AND WORKABILITY TEST APPARATUS FOR AN ENVIRONMENTAL MONITORING SYSTEM

BACKGROUND OF THE INVENTION

This invention relates to environmental monitoring systems and in particular to apparatus which samples the workability and reliability of environmental detector units coupled in such systems.

Environmental monitoring systems are useful to monitor environmental abnormalities such as, fire, smoke, water leakage, gas leakage and the like at various locations in buildings, building complexes and/or other properties.

Such monitoring systems generally include a number of detector units dispersed in various locations throughout the property, each designed with a sensor to sense an environmental parameter (e.g., temperature, smoke, gas, water, etc.) for abnormality and to generate a signal indicative of such abnormality. A computer is arranged to supervise the detector units for abnormality data collection operations and control operations. Among the control operations is a test for workability of a sensor, say a smoke sensor.

One known technique for testing such sensors involves maintenance personnel walking through the property and deliberately activating the sensors, for example, injecting smoke into smoke sensors to simulate the abnormality condition. The sensor output signal is captured at the detector location and collected by the central computer for evaluation of sensor workability. A disadvantage of this technique is the need for walk through personnel and their need for communication to an operator at the central computer. Because of the labor cost and the time required to conduct such a walk through test, the testing operation is conducted rather infrequently.

Another known technique for sensor workability testing is described in U.S. Pat. No. 4,518,952 which discloses an alarm system in which the sensors are tested for workability from a remote location, thereby obviating the need for walk through maintenance personnel. In this system the test involves a computer (located remotely of the sensors) which sends to a terminal unit having a sensor to be tested a test instruction signal. The terminal unit responds by generating a predetermined test voltage that is applied to the sensor. The sensor responds with an analog output voltage that is the sum of the test voltage and the ambient voltage of the sensed parameter. This analog output voltage is then converted in an analog to digital converter to a digital signal that is sent to the computer for evaluation.

The system of the above-mentioned patent does not disclose any means for dealing with tolerance problems such as (a) variations in the ambient signal conditions (e.g., a room that is sometimes vacant and at other times occupied with smokers, or simply changes in humidity and/or dirt content in the air) and/or (b) drift of the analog to digital converter due to aging, component selection, etc. Moreover, there is no disclosure of how often or on what basis the test is to be conducted relative to data collection operations performed in the system.

One solution to the tolerance problems is to set the abnormality threshold (and the predetermined test voltage) so as to yield the maximum digital output value of the analog to digital converter for the abnormality condition. Although this solution may be suitable for determining workability of the sensor, degradation or drift of the analog to digital converter could very well go undetected.

SUMMARY OF THE INVENTION

An object of the present invention is to provide novel and improved test apparatus for an environmental monitoring system which provides test results that are determinative of detector unit workability and reliability within a tolerance range or window.

Another object of the present invention is to provide novel and improved test apparatus for an environmental monitoring system which allows for real time testing of detector units without interruption of abnormality data collection other than for a unit under test.

In accordance with the above objects, one feature of the invention is embodied in an alarm system in which a controller is arranged to send test instructions to detector units via a transmission line. Each detector unit has a means to limit the amplitude of the analog output signal of the sensor to a maximum value that under ideal tolerance conditions results in the digital output signal value of the analog to digital converter being mediate a tolerance range of values, the upper limit of which is less than the maximum value obtainable from the converter. The controller is provided with means for determining if the digital signal test value is within the tolerance range and issuing an output indicative of the test value being outside the range.

In accordance with the above objects, another feature of the invention is embodied in an environmental monitoring system having a transmission line, a plurality of detector units coupled to the line and a controller arranged to sequentially address the units one by one with a message for a data collection operation or a test operation and to receive data from the unit so addressed. In accordance with the invention, the controller is provided with a program which directs the polling such that a test instruction is sent sequentially on the successive loop polls, where a loop poll is one poll of the units coupled to the line.

BRIEF DESCRIPTION OF THE DRAWING

In the accompanying drawing like reference characters denote like elements of structure, and.

DETAILED DESCRIPTION OF THE PREFERRED EMBODIMENT

Figure 1:
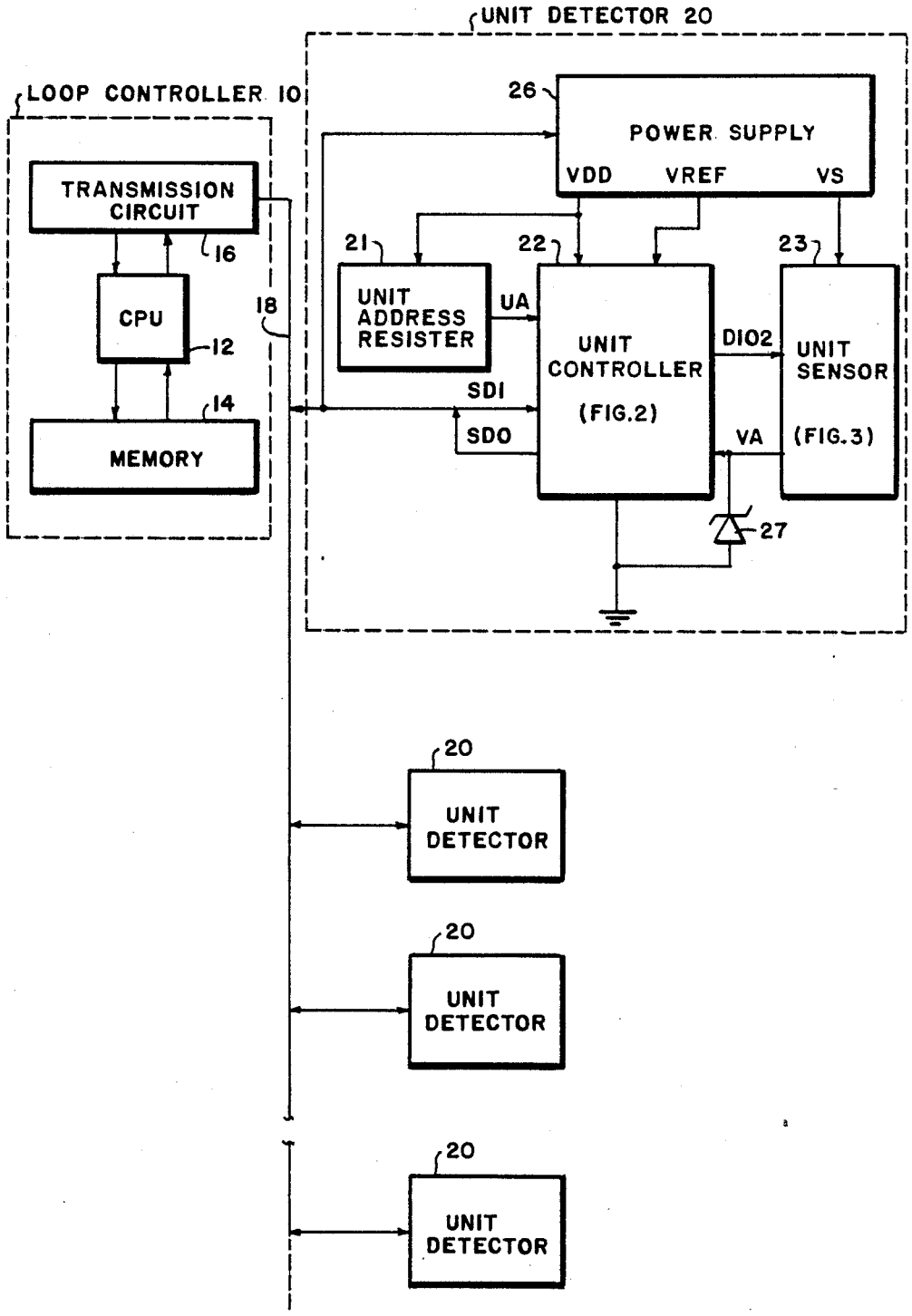
FIG. 1 is a block diagram of an environmental monitoring system according to a preferred embodiment of the invention.

Apparatus embodying the invention can be employed in any environmental monitoring system where it is desirable to sample the reliability and/or workability of detector units coupled in the system. However, by way of example and completeness of description, the test apparatus will be described in a fire protection system which will be first described in detail with reference to FIG. 1.

A loop controller 10 includes a central processing unit (CPU) 12, a memory 14 and a transmission circuit or interface 16. The loop controller 10 communicates with a master controller (not shown), both forming part of a control panel arrangement at a central station.

A program, involving the storage of data in the memory 14, is executed by the CPU 12 in a manner well known to those skilled in the art. The CPU 12 supplies address and command signals to the transmission circuit 16 for transmission on a serial basis by the transmission line or loop, shown as a single line 18, to a plurality of detector units 20 distributed along the length of the line. For instance, line 18 will be disposed in a zone or area of a building with the unit detectors located in various rooms, hallways, stairwells and the like of such zone.

The loop controller program includes a poll routine by which it sends data collection messages and/or control messages sequentially to the unit detectors 20. Essentially, the loop controller proceeds to address the detectors 20, one by one, sequentially until each has been addressed and then starts the poll process over again on a cyclic or periodic basis.

Each unit detector 20 includes a unit address register 21, a unit controller 22, a unit sensor 23 and a power supply 26. The power supply 26 is arranged to furnish DC voltages VDD and VREF to the unit controller, VDD to the unit address register and VS to the unit sensor. As such, it includes an appropriate voltage regulator and divider network and preferably derives d.c. energy from the transmission line 18. That is, the loop controller 10 additionally supplies d.c. power over the line 18 to the unit detectors 20 as is well known in the art. It will be appreciated that power could also be derived locally from a battery or an a.c. source with rectification.

The unit controller 22 receives data in serial form from the loop controller 10 via transmission line 18 to its input terminal SDI and sends data in serial form from its output terminal SDO to the loop controller 10. The unit controller 22 inspects each message sent by the loop controller and upon a match of the message address with the detector's self address stored in unit address register 21, becomes operative to perform a data collection or a control operation. One of the control operations, germane to the present invention, is a test (supervisory test) of the workability and reliability of the unit controller 22 as well as of the unit sensor 23. In response to a test command, the unit controller 22 provides a test signal over line DIO2 to the unit sensor 23. This signal is sufficient in amplitude to place the unit sensor in alarm condition. The unit sensor 23 returns its output signal VA to the unit controller 22.

Figure 2:
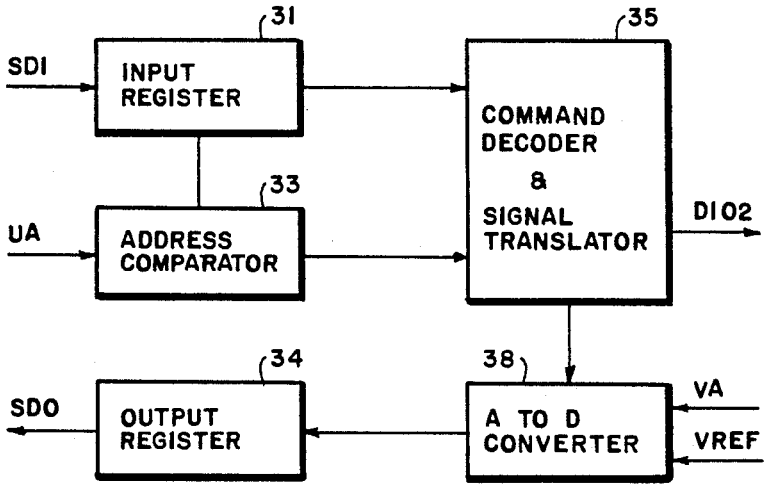
FIG. 2 is a block diagram of a unit controller employed in a detector unit of the environmental monitoring system of FIG. 1.

The unit controller 22 is illustrated in more detail in FIG. 2 as including an input register 31, an address comparator 33, an output register 34, a command decoder and signal translator 35 and an analog to digital (A to D) converter 38. The input register 31 is arranged to receive the loop controller messages via line SDI. Address comparator 33 compares the address in register 31 with the unit address on line UA from the unit address register 21 (FIG. 1). Upon a coincidence or match of the two addresses, the address comparator 33 provides a coincidence signal to the command decoder and signal translator 35.

When the operation specified by the address message is a data collection operation, the command decoder and signal translator supplies an enable signal to the A to D converter. The A to D converter 38 responds to the enable signal to convert the sensor analog output signal VA to a digital value that is placed in output register 34 for transmission from the SDO terminal via transmission line 18 to the loop controller 10 (FIG. 1). On the other hand, if the operation specified by the address message is a control operation, specifically a test instruction command, the command decoder and signal translator 35 provides on its DIO2 output lead a test signal of sufficient amplitude to place the unit sensor in an alarm state. The sensor output signal VA indicative of the alarm state will be converted by A to D converter 38 to a digital value and ultimately placed in output register 34 for transmission via transmission line 18 to the loop controller 10 (FIG. 1).

The unit controller 22 may typically be an Application Specific Integrated Circuit (ASIC), known as EWD106, manfactured by Fuji Electronics Limited. As such, the unit controller ASIC includes numerous transistor components which are subject to drift, particularly in an A to D converter. Typically, an A to D converter compares the sensor analog output voltage VA to a reference voltage VREF and generates an output digital value within a value range of 0 to N, where N is the maxiumum output value of the converter. To perform this signal conversion the A to D converter will include a resistive voltage divider network and a transistor switch translator. Resistors as implemented in integrated circuits are subject to drift, i.e., change in value due to various factors such as semiconductor material impurities, stresses, temperature variations, aging and the like. This can seriously affect the A to D output value for a given VA input voltage.

As an example, consider a reference voltage VREF equal to 4 volts and the A to D maximum output value N equal to 31. For a typical ambient environment, VA equals 1.5 volts. The A to D converter ideally will respond with a digital output value of 9. An alarm condition is defined as the sensor output voltage VA being equal to or greater than the VREF, i.e., equal to or greater than 4 volts. The A to D converter responds to the alarm condition to produce an output digital value of 31 (its maximum value). Under these conditions a typical test signal on lead DIO2 (FIGS. 1 and 2) will result in an A to D output value of 31 under ideal conditions.

However, drift can cause the value 31 to occur at some VA value either greater or less than 4 volts. If greater, the sensor unit will be in alarm, and the output digital value will be 31. This results in an alarm when in fact there may not be one, thereby resulting in the annunciation of false alarms. If lesser, the A to D output value will be less than 31 and no alarm will be annunciated when in fact there should be.

Another factor that influences the A to D output value for the test comand is the ambient value of VA which can vary significantly due to dirty air, humidity or smokers at the sensor location. Measurements show that this ambient value of VA can result in an ambient A to D output value to a fall within a wide spread of 2 to 18.

One feature of the invention is to remove the uncertainty of ambient value variance and provide a tolerance window within which an alarm output value will be valid. This is accomplished by employing an amplitude limiting or a clamping circuit to limit the VA voltage to a certain maximum value which under ideal conditions will yield a digital value which is less than the A to D maximum output value N. Preferably, this digital value is less than N by one-half or more of a tolerance range or window. This permits interpretation during the supervisory test of the A to D output value as a valid alarm if within the tolerance window and as a faulty sensor unit or ASIC chip if outside the window.

For a typical design in which the invention is embodied, the clamping circuit is illustrated in FIG. 1 as a shunt Zener diode network having a Zener diode 27 coupled between the VA line and circuit ground. This typically limits VA in maximum value to 3.8 volts, which under ideal conditions, results in an A to D output value of 27. The tolerance window is set (in the loop controller 10) at 27 plus or minus 3, resulting in a tolerance window of 24–30. As will be described in more detail below, the loop controller program will interpret the supervisory test results as valid if falling within the tolerance window and invalid if falling outside such window. It will be appreciated that the amplitude limiting circuit can alternatively employ a network of conventional diodes, band gap diodes, controlled low tolerance resisters and the like.

The unit address register 21 may be any storage register, but preferably takes the form of a series of switches, one for each bit in the address, that are capable of being set manually such that a closed position of a switch provides an output value of VDD and an open position of the switch provides an output value of 0, corresponding to the binary values 1 and 0, respectively. Of course, the output line UA will then consist of a lead for each bit in the address, i.e. the address will be presented in parallel to the unit controller.

Figure 3:
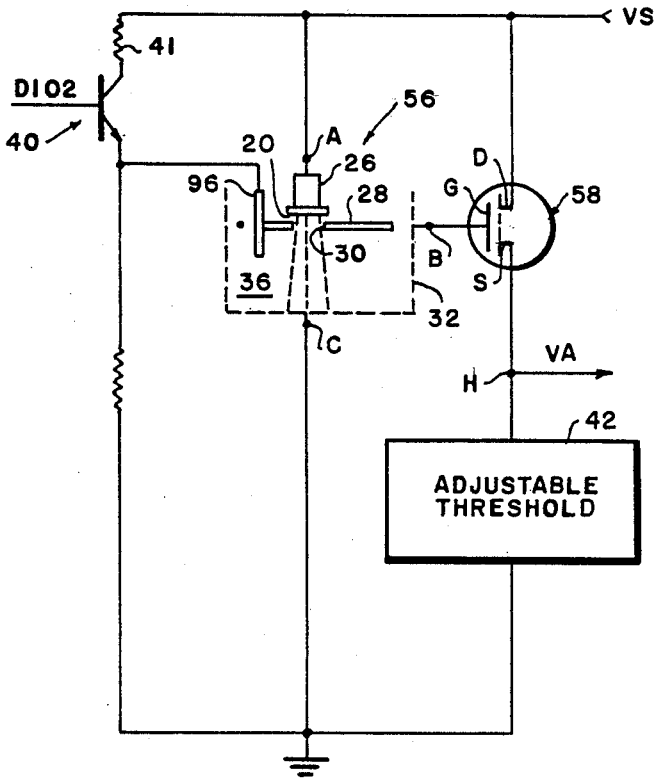
FIG. 3 is a block diagram in part and a circuit diagram in part of a unit sensor employed in a detector unit of the environmental monitoring system of FIG. 1.

The unit sensor 23 can be any appropriate sensor for detecting temperature, smoke, water leakage and the like in a fire protection system. By way of example, the unit sensor 23 may be a smoke detector of the type described in U.S. Pat. No. 4,401,979 which has been modified for control by a test instruction signal as shown in FIG. 3. The primary modification is the replacement of a magnetic switch for a smoke simulation test with a transistor 40. The transistor 40 is an NPN transistor having its base lead connected to respond to the DIO2 test signal from the unit controller 22. The transistor 40 is connected for operation in the emitter follower mode. To this end, its collector electrode is coupled via resistor 41 to the smoke detector supply voltage VS and its emitter electrode coupled to energize the probe 96 in the ionization chamber in the same manner as described in U.S. Pat. No. 4,401,979.

Suffice it to say here that the FIG. 3 smoke detector is of the ionization type having an ionization chamber in which a screen electrode 32 defines the outer limits thereof. Disposed within the chamber is a first inner electrode 24, a second intermediate electrode 28 having an opening 30 and retained at a fixed distance from the end of electrode 24. Electrodes 24, 28 and 32 are connected respectively to the points A, B and C. The output of the ionization chamber is taken from point B which is connected to the gate of the field effect transistor 58. The source and drain of the field effect transistor are connected in circuit with the supply VS and an adjustable threshold network 42. The analog output voltage VA is taken from the point H which is identical to the source S of the field effect transistor 58. The operation of the smoke detector is as described in the aforementioned U.S. Pat. No. 4,401,979.

Another feature of the present invention involves the performance of the supervisory test of the detector units as proceeding without interruption and in step with normal analog data collection from the detector units. In essence, one detector is tested during a poll of the detectors coupled in the loop (to line 18 of FIG. 1) while all of other units are instructed to return data or perform some other control function. During the next poll of the loop, a different detector is tested and so on until all detectors to be tested have been tested. Of course, the process will be interrupted if an alarm is sensed and interpreted as placing the system under alarm.

Figure 6:
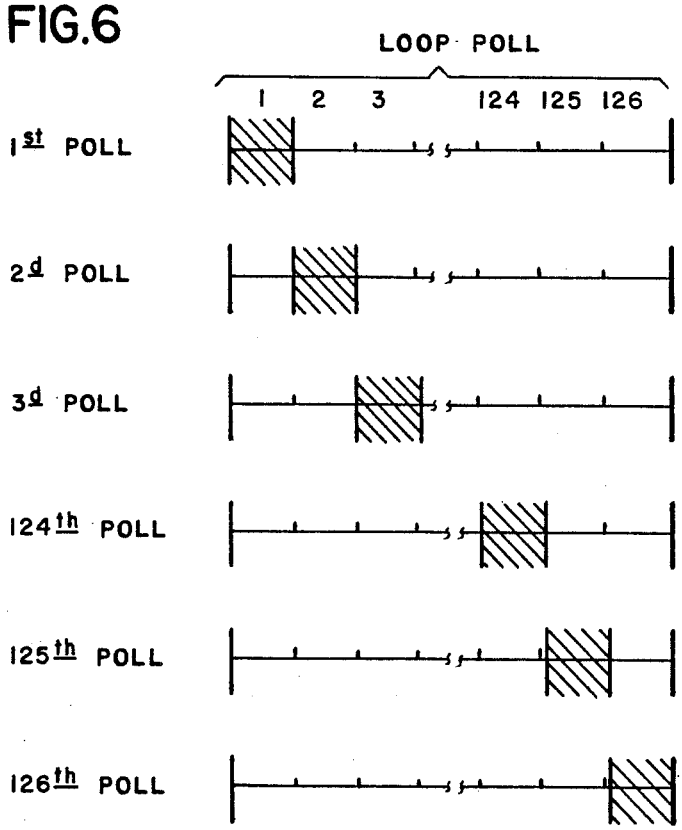
FIG. 6 is a time diagram illustating the progression of the supervisory test from one detector unit to another during a system poll.

This is illustrated in the time diagram of FIG. 6 which shows such a progression of the detectors under test on successive loop polls for a system having a capability of 126 detectors. In this diagram, the 1st, 2nd, 3rd, 124th, 125th and 126th loop polls are shown with detector poll times for detectors 1, 2, 3, 124, 125 and 126. As will be developed below, the detector poll time may have varying widths due to varying message widths and some detectors may require more than one message for the operation required. In any event, a cross-hatched time slot represents the detector under test. Thus, during the first loop poll, detector 1 is under test. During the second loop poll, detector 2 is under test and so on until when the 126th detector is under test. The process then begins anew and is repeated.

Figure 7:
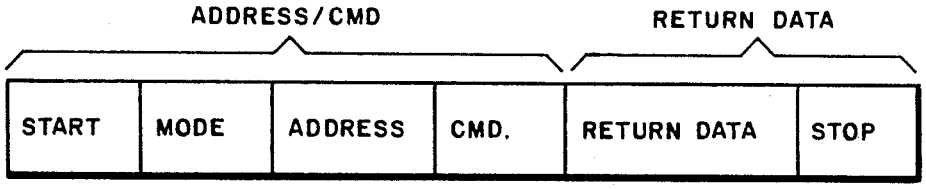
FIG. 7 is a block diagram illustrating the protocol of a detector time slot as employed in communication between the loop controller and a unit controller of the monitoring system of FIG. 1.

The protocol for a detector time slot is illustrated in FIG. 7 to have an address/command message period followed by a return data period. During the address/command period, the loop controller sends in serial order a start field, mode field, address field and command field. The start field signifies the start of a message. The mode field identifies whether the operation is a data collection operation or a control operation. The address field identifies the particular detector unit that is to respond to the message. The command field identifies a specific control operation for the detector unit. Of particular interest to this invention is a command for a supervisory test control as well as a reset control.

The return data period begins with a return data field in which the detector unit returns data to the loop controller and is followed by a stop field which signifies end of the return transmission. When the mode signifies a command, the return data period may be reduced, thereby reducing the time width of the detector time slot.

Due to verification requirements and/or field width limitations (due to device restrictions in the ASIC chip and/or in the loop controller), several consecutive detector time slots may be needed to complete an operation. For example, it is preferred to use five consecutive detector time slots for a supervisory test operation as follows:

1. Test Command;
2. Test Command;
3. Data Collection;

4. Reset Command;
5. Reset Command;

For the test operation, two test commands must be received before the detector unit will perform the test. The test is performed in response to the second test command. In practice the test signal on lead DIO2 is held on continuously until reset. During the third time slot, the analog test data VA is converted to digital form and sent to the loop controller where it is evaluated. During the fourth time slot, the loop controller sends a reset command. However, the unit under test will not respond until it receives a second reset command during the fifth time slot. The detector then responds to reset itself and remove the test signal from lead DIO2.

It should be apparent to those skilled in the art that arrangements other than the above could be employed. For instance, verification of the test command or of the reset command could be omitted. The analog test output could be converted to digital form at any time that the sensor and A to D circuits stabilize and then stored for collection whenever appropriate in a particular protocol design.

In view of the above, a dectector poll time consists of one or more consecutive detector time slots having the same address field. A loop poll time consists of the sum of the possible detector poll times on the loop. For the above design example of 126 possible detectors, the loop poll time consists of 126 detector poll times. A system poll time consists of a number of loop poll times equal to the number of detectors actually coupled in the loop. Thus, in the 126 possible detector loops if only 50 detectors were actually coupled in the loop, a system poll time would consist of 50 loop poll times.

Figure 4:
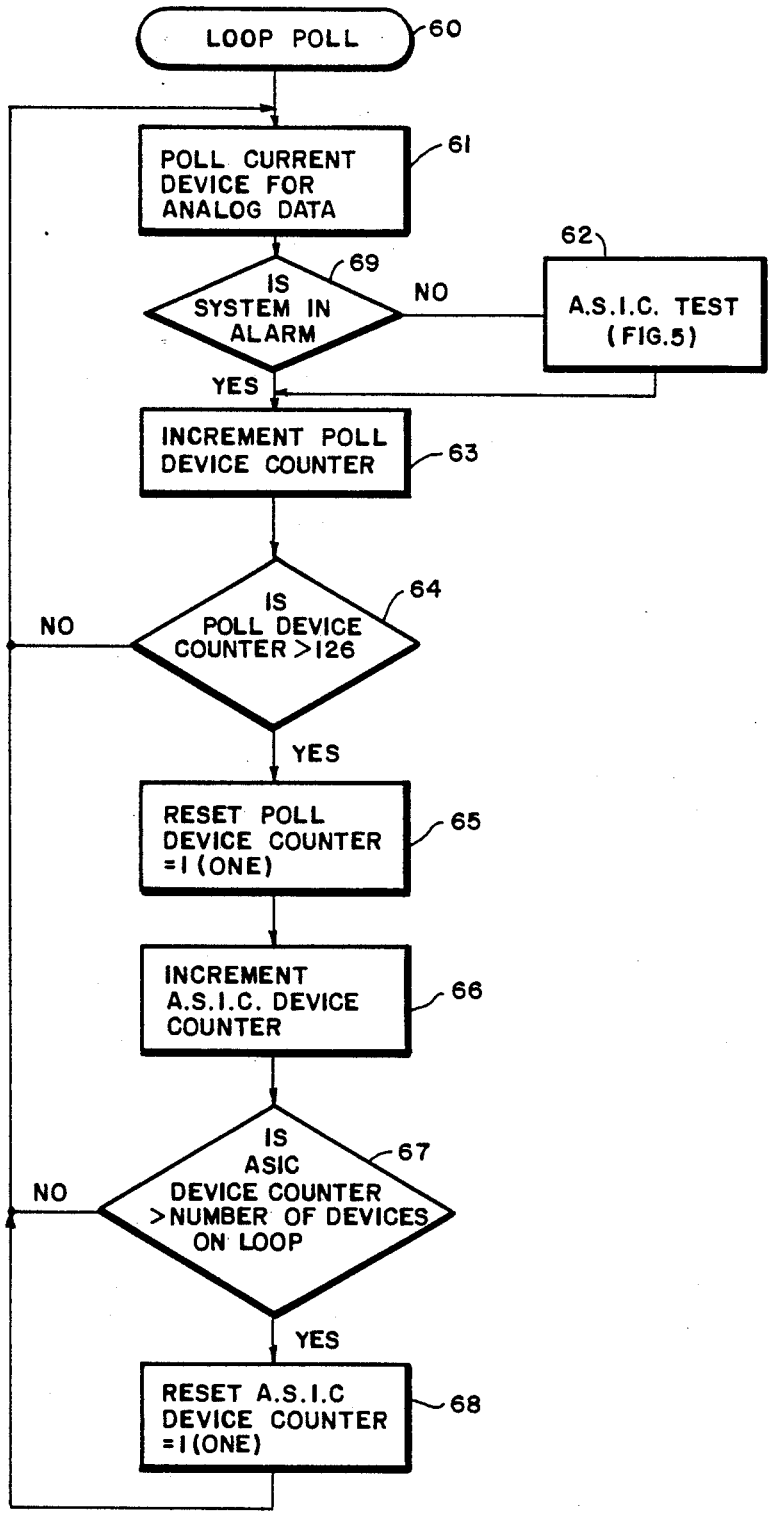
FIG. 4 is a flow diagram of the poll program employed in the loop controller of the monitoring system of FIG. 1.

The polling routine of the loop controller 10 including the progressive supervisory test will now be described in with reference to FIG. 4 that shows the interface of the supervisory test with the device (detector) addressing portion of the polling program. Block 60 represents the start of the loop poll program. At the first functional box 61, the current device (as indicated by a device poll counter) is polled for analog data. Control then shifts to block 69 for a determination of whether the system is in alarm. If so, the supervisory test is not performed, the poll device counter is incremented and normal polling for analog data collection continues around the loop. If the system is not in alarm, the supervisory (ASIC) test is performed at block 62. After the test, control is passed to block 63 to increment the poll device counter. At box 64, a comparison is made to see if the poll device counter is within the range of the maximum number of devices on the loop. If the device counter is within the range specified, control is returned up to box 61 so as to poll the remaining devices.

If the poll device counter is outside the range specified (box 64), the poll device counter is reset to 1 at box 65. Control is then passed to box 65 were the AS C test counter is incremented. The ASIC test counter count value represents the current device or detector for which the supervisory test is to be conducted. At box 67, a comparison is then done to assure that the ASIC device counter is less than the maximum number of devices coupled in the loop. If so, control is returned to box 61 and polling is resumed. If the ASIC device counter is greater than the number of devices coupled in the loop, the ASIC counter is reset to 1 at box 68. Control then returns to box 61 where the poll procedure is repeated.

Figure 5:
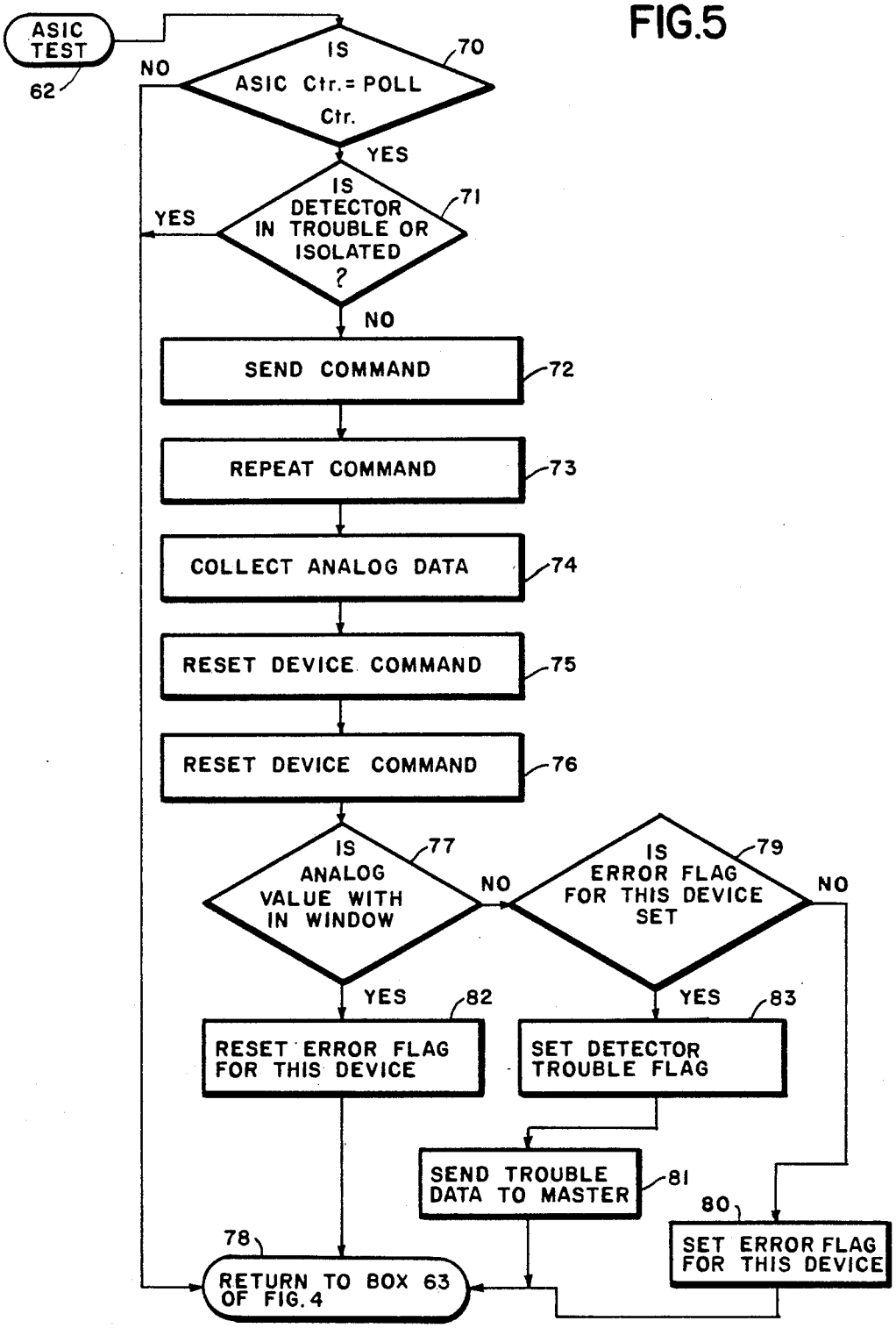
FIG. 5 is a flow diagram of the supervisory test program employed in the loop controller of the monitoring system of FIG. 1.

The ASIC test routine will now be described with reference to the flow diagram of FIG. 5. This routine is entered at box 62 of FIG. 4 which is also reproduced in FIG. 5 as the start box. The first functional box 71 in FIG. 5 is a comparison to see if the AS C test counter is equal to the poll device counter. If not equal, control returns as indicated at box 78 to the normal polling routine at box 63 in FIG. 4. If equal, a determination of whether the current detector is in trouble or isolated is made at box 71. If either, control passes via box 78 to box 63 of FIG. 4 for resumption of normal polling. If the current detector is not in trouble or isolated, a command sequence is initiated for the supervisory test to be conducted on the current device as represented by boxes 72–76.

The first command sent (box 72) is a test command. Box 73 indicates that the test command is repeated. As mentioned above, the detector unit controller responds to the second consecutive test command to conduct the test. Box 74 indicates that during the next time slot, an analog data collection operation is performed. Boxes 75 and 76 illustrate that the test command sequence is completed with two consecutive reset commands. It will be appreciated that delays between these commands may be needed to allow for response time of the detector unit controller as may be required by ASIC chip design.

At box 77, a comparison is done to see if the test result data collected is within the tolerance window. If so, an error flag for the current device is reset at box 82. Then box 78 returns you back to the normal poll routine indicated at box 63 on FIG. 4. If the data is not within the tolerance window, the current device error flag is checked at box 79 to see if it has been set. This error flag is used to see if the test for the current device has failed a previous time. If not, the error flag is set at box 80 and control returns to normal polling again at box 63 in FIG. 4.

Essentially, there is an error flag register in the loop controller memory that has a flag for each potential device in the loop. In order for the test to result in an output signal indicating trouble, the device output signal must be outside the tolerance range on two consecutive system polls. If the error flag of a device is set during one system poll and then during the next system poll the device does not give a value outside the range, the program moves from box 77 to box 82 where that error flag will be reset as described above.

Returning now to box 79, if indeed the error flag had been set in the previous loop poll time, the control moves to box 83 so as to set a detector trouble flag. Next, the loop controller at box 81 generates a signal indicative of the trouble and sends it to the master controller referred to above (but not illustrated in FIG. 1). Control then returns to the normal poll routine at box 63 in FIG. 4.

It will be appreciated that the invention provides a test of the workability and the reliability of not only an analog sensor but also a corresponding A to D converter at a detector location in response to a test instruction provided by a controller. In addition the controller includes a program which directs the polling such that a test instruction is sent sequentially to the units on successive loop polls where a loop poll is one poll of all the units coupled to the line whereby the unit under test progresses from one detector to another on successive loop polls.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. Test apparatus for an alarm system in which one or more detector units is coupled to a transmission line and a controller is arranged to address the units via the transmission line with messages, where one of the messages is a test command, each unit including (i) a sensor responsive to an environmental abnormality to produce an analog output signal indicative of such abnormality, (ii) an analog to digital converter for converting such analog output signal to a digital signal having a variety of values up to a maximum of N, (iii) means responsive to a test command to cause said sensor analog output signal to assume a test value simulative of the abnormality and (iv) means for transmitting from the converter to the controller a digital signal test value corresponding to the assumed test value of said sensor analog output signal, the improvement comprising:

each unit further including means to limit the amplitude of the sensor analog output signal to a maximum value that under a no drift condition of the analog to digital converter results in the digital signal test value being mediate a tolerance range of values, the upper limit of such range being less than N, the controller including means for determining if said digital signal test value is within the tolerance range and issuing a trouble output indicative of the test value being outside the range.

2. Test apparatus as set forth in claim 1 wherein the maximum digital signal value under ideal condition is at the midpoint of the tolerance range.

3. The test apparatus as set forth in claim 1 wherein the amplitude limiting means is a Zener diode circuit coupled in shunt with the analog output signal of the sensor.

4. Test apparatus as set forth in claim 2 wherein the determining means issues the trouble output only if a unit's test result is outside the tolerance range on two consecutive tests.

5. In an environmental monitoring system having a transmission line, a plurality of unit detectors coupled to the line and a controller coupled to the line and arranged to sequentially address the units one by one with a message for a data collection operation or a test operation and to receive data from the unit so addressed, the improvement comprising:

the controller comprising means, including a program, for directing the polling such that a test instruction is sent sequentially to the units respectively on successive loop polls, where a loop poll is one poll of all the units coupled to the line, whereby the testing of the units progresses among the units, one by one, in successive loop polls.

6. The invention according to claim 5 wherein the program controls (i) a detector address counter for sequentially addressing the the units during a loop poll, (ii) a detector unit test counter for sequentially addressing the detector units for tests on successive polls, and (iii) a test routine that causes the controller to send a test instruction to that unit whose address coincides with the address values of both counters.

* * * * *